US009234383B2

(12) United States Patent
Bruno

(10) Patent No.: US 9,234,383 B2
(45) Date of Patent: Jan. 12, 2016

(54) MODULAR DOOR ASSEMBLY

(71) Applicant: Treebus Inc., Woodbridge (CA)

(72) Inventor: Salvatore Bruno, Woodbridge (CA)

(73) Assignee: Treebus Inc., Woodbridge (CA)

( * ) Notice: Subject to any disclaimer, the term of this patent is extended or adjusted under 35 U.S.C. 154(b) by 0 days.

(21) Appl. No.: 14/081,620

(22) Filed: Nov. 15, 2013

(65) Prior Publication Data

US 2014/0165488 A1 Jun. 19, 2014

Related U.S. Application Data

(63) Continuation-in-part of application No. 13/713,723, filed on Dec. 13, 2012, now Pat. No. 8,984,821.

(51) Int. Cl.

| | |
|---|---|
| ***E06B 3/673*** | (2006.01) |
| ***E06B 3/964*** | (2006.01) |
| ***E06B 3/74*** | (2006.01) |
| ***E06B 3/984*** | (2006.01) |
| *E06B 3/72* | (2006.01) |

(52) U.S. Cl.

CPC ..... *E06B 3/74* (2013.01); *E06B 3/9649* (2013.01); *E06B 3/984* (2013.01); *E06B 3/72* (2013.01); *Y10T 29/49826* (2015.01)

(58) Field of Classification Search

CPC ..... E06B 3/673; E06B 3/96; E06B 3/964; E06B 3/72

USPC ..... 52/654.1, 655.1, 210, 213, 286, 281, 52/284, 285.4, 745.05, 745.06, 745.09, 52/745.15, 456, 455, 457, 458

See application file for complete search history.

(56) References Cited

U.S. PATENT DOCUMENTS

| | | | | | |
|---|---|---|---|---|---|
| 635,341 | A | * | 10/1899 | Nash | 52/656.4 |
| 2,706,543 | A | * | 4/1955 | Kammerer | 52/455 |
| 5,086,601 | A | * | 2/1992 | Galowitz et al. | 52/656.2 |
| 5,351,459 | A | * | 10/1994 | Kassl et al. | 52/656.5 |
| 5,363,625 | A | * | 11/1994 | Philippi | 52/653.2 |

* cited by examiner

*Primary Examiner* — Phi A

(74) *Attorney, Agent, or Firm* — Eric L. Lane; Green Patent Law

(57) ABSTRACT

The present invention relates to a modular door having at least one door panel, premanufactured stiles and at least two rails, and is held together using rods optionally having at least one stabilizer; a modular door kit containing said components; and a method of assembling a modular door having said components without requiring adhesives or any extra fasteners.

22 Claims, 20 Drawing Sheets

MODULAR DOOR ASSEMBLY

RELATED APPLICATIONS

The present application is a Continuation-in-Part of U.S. application Ser. No. 13/713,723 filed on Dec. 13, 2012, whose contents are expressly incorporated by reference.

FIELD OF THE INVENTION

The current invention pertains to new and useful improvements to a door assembly process utilizing mortises, tenons and dowels as well as use of dowels for locking door stiles and rails.

BACKGROUND OF THE INVENTION

Millions of doors are assembled, installed and renovated every year. The process of manufacturing and assembling door is long and complicated; usually it takes several hours to assemble and install a door. Generally, the door is supplied as fully assembled with or without a frame. If the door is supplied without a frame, then prior to installation, the hinges and locks have to be drilled, cut and attached to the door and the frame. Generally, most of the doors have to be prepped for hardware prior to installations; this procedure requires a manipulation of a heavy door.

The manufacturing process requires that the door assembly be glued to keep the parts together, and during the gluing process the door has to be locked in special clamps to keep its integrity. The glue requires an extensive curing time before the rest of the door assembly can be completed. Following the gluing process, the door stiles have to be beveled in order to allow smooth closure of the door. The beveling process is known in the art and involves a removal of some layer(s) of material from the stiles on the hinge and/or lock side, thus creating a vertical plane with a slope of approximately 2-3 Degrees. Only after beveling can the whole door be sanded, prepped and painted or covered by protective layers known in the art.

This lengthy and involved door manufacturing process allows delivery of fully assembled doors. Delivery of doors in a disassembled state is not possible as the gluing and beveling process can only be performed on the manufacturing site. Furthermore, in the current process if a part or parts of the door are damaged during transportation, the entire door is considered broken and must be replaced.

In the case of a modular door, only the damaged part needs to be replaced.

The delivery of disassembled doors has the following benefits: they take less space, the risk of breakage is reduced, and if there are broken parts, they can be easily replaced by spare parts. However, disassembled doors need to be assembled on-site by the end user. Therefore, a kit for door assembly is required in which the stiles are beveled prior to the assembly. The assembly kit does not require any complicated tools and ordinarily does not require use of glue.

One of the technologies used in door building and manufacturing is the use of mortise and tenon. This technology is well-known and described for example, in U.S. Pat. No. 541,450. This patent teaches a door comprising styles and rails, which are suitably mortised and tenoned together while dowel pins are inserted into the long side of the stiles and pass through both tenons while remaining invisible. This locking means is generally used to improve sturdiness of the final product but does not eliminate the use of glue during the door assembly. There is a further technology of mortise and tenon with protruding dowel also disclosed in the U.S. Pat. No. 5,086,601. This patent teaches a construction of frames for windows and doors while utilizing a joint structure with mortise and tenon.

The present invention addresses the deficiencies in prior art by providing an improved method of door assembly by reducing or virtually eliminating a use of glue. The invention also provides a kit for self-assembly of a modular door and method of manufacturing such kit.

SUMMARY OF THE INVENTION

The current invention pertains to new and useful improvements to a door assembly and an assembly process utilizing mortises, tenons and dowels as well as use of dowels (rods) for locking door stiles and rails.

In one aspect of the invention there is provided a modular door comprising:

a. at least one door panel having a top, a bottom and two sides;

b. a first pre-manufactured stile having a first end, a second end and two sides; one of said sides further comprising at least one mortise, preferably a plurality of mortises, c. a second pre-manufactured stile having a first end, a second end and two sides; one of said sides further comprising at least one mortise, preferably a plurality of mortises, d. wherein each stile further comprises a first passageway having a diameter for receiving at least one rod, preferably a plurality of rods, wherein said first passageway extends from the first end of the stile to the second end of the stile passing through at least one of said mortise of the stile;

e. a first pre-manufactured rail having two sides, a first end defining a first tenon and a second end defining a second tenon, wherein each tenon has an aperture having a diameter to matingly receive at least one rod, preferably a plurality of rods;

f. a second pre-manufactured rail having two sides, a first end defining a first tenon and a second end defining a second tenon, wherein each tenon has an aperture to matingly receive at least one rod, preferably a plurality of rods; preferably each of said first passageway and said aperture are substantially of the same diameter; each of said stiles and rails for use in enclosing said at least one door panel;

g. optionally, at least one intermediate pre-manufactured rail having two sides, a first end defining a first tenon and a second end defining a second tenon, wherein each tenon has an aperture to matingly receive at least one rod, preferably a plurality of rods, and positioned between said first rail and said second rail and enclosing said at least one door panel;

h. each of said rails being attachable to the first and second stiles by said mortise of said stile engaging with said tenon of said rail, further affixed in place by at least one rod, preferably a plurality of rods; and i. wherein at least one rod, preferably two of the plurality of rods locks a single rail, preferably a plurality of rails inside the corresponding stile, wherein upon the insertion of said tenon into said mortise of each stile, the first passageway and apertures are positioned offset one to another, wherein upon insertion of at least one rod, preferably a plurality of rods, into said first passageway and apertures, each tenon is tightly locked into its corresponding mortise;

wherein the at least one of said rods further comprises at least one stabilizer.

Another aspect of the invention is to bevel and prep the hardware during the manufacturing process in such a way as to give the end user the ability to assemble a door without the use of glue or a door clamp press. The elimination of glue allows disassembly of the door if needed.

The glue-less construction of the door creates multiple advantages and options of improving the design, style, workability, integrity, reuse, and repair if needed as the process allows the end user to take the door apart after it has been assembled, resulting in a considerable savings in time and money by placing the customization factor into the users' hands.

In one embodiment, the assembly is carried out using a traditional mortise and tenon joint in the door assembly. In its preferred embodiment, an aperture is created within the tenons on the rails at both ends while a passageway is created along the entire body of the stile. This passageway stops short of the mortises at the top and bottom of the stile. Thereafter, an oversized hole is preferably drilled in the stile for accommodating a bushing. The bushing completes the passageway, by retaining integrity of the stile and enabling rods to be pre-inserted without added friction. This function is useful during assembling or disassembling multiple rail configurations.

Preferably, the corresponding apertures in the tenons and passageway are slightly off-set to one another. In this way, when assembled the stiles and rails in combination with the rod/bushings being driven into their final resting position create an opposing force so all mortise and tenons are pressed and locked together for all stiles and rails simultaneously.

Finally, driving a screw through the bushing into the stile locks the bushings and rods in place.

In another embodiment, the at least one door panel is friction-fitted by the stiles and rails. Preferably, the at least one door panel is fitted within a pre-formed channel disposed along the sides of the stiles and rails.

The current invention eliminates the use of glue and the use of a door clamp press, which has a direct result of eliminating the curing time, beveling and prepping for hardware after the assembly for the end user.

Beveling and prepping for hardware is done during the stile manufacturing process. The manufacturing process dictates the use of a clamp press with two parallel surfaces in order to prevent buckling and deformation of the door under force.

If needed, the stile can be matched to an existing opening, transcribing the original hardware placement to the new door or in this case stile. Since the single stile can be handled, the marking of the hardware makes this a much easier task to handle in place of a fully assembled door. After prepping the stile, the door can be assembled and immediately installed without a wait for glue curing and other door preparations utilized in prior art.

Another aspect of the invention is the use of one or more extensions to the rails of the door. These extensions can be used on the top and/or bottom rails. The end user's choice of different materials such as wood, metal, Plexiglas™, plastic or composite material extension will give the door a unique look. In addition, use of extensions can make it more resilient to the elements. Using a rubber or silicon cover on the extension may, for example, assist in reduction of water damage to the door. Furthermore, use of extensions would allow replacement of the extension only if it became soiled or broken, without need to replace the whole door.

In a preferred embodiment, the at least one rod, preferably a plurality of rods comprises pushing rods, locking rods, and locking/pushing rods. The pushing rods are provided to deliver the locking rods into the tenons of the intermediate rail, while the locking/pushing rods are provided to lock one rail as well as to push another locking or pushing rod through the rod receiving channel of the stile.

According to yet another aspect of the invention, the set of rods further comprises an unlocking rod having the length equal to the height of the tenon of the corresponding rail to be unlocked. These unlocking rods are positioned between the pushing rods and the locking rods, and can be pushed into the tenon of the rail while removing the locking rod from the tenon to release the intermediate rail from the stile.

According to yet another aspect of the invention, the at least one of said rods, preferably said locking rods, further comprises at least one stabilizer, preferably an o-ring, positioned on said rod, to minimize movement of said rod in said passageway and/or aperture. Preferably, said stabilizer is substantially the same diameter as the diameter of the passageway and/or aperture. In a preferred embodiment, the o-ring may be made of any material known in the art for making O-rings including, but not limited to, polymeric elastomer, natural rubber, synthetic rubber, and combinations thereof. The function of the o-ring is to ensure a snug fit of the locking rod in the passageway and/or aperture whilst minimizing the locking rod from moving around in the passageway of the stiles and aperture of the rails.

According to another embodiment, the at least one stabilizer is integral with at least one of said rods. The integral at least one stabilizer is, in one embodiment, made from the same material as the rod and may be in a shape conforming to a shape of the passageway and/or aperture. In another embodiment, the at least one stabilizer is moveable along a length of at least one of said rods. In another embodiment, the stabilizer may be in the form of a collar, for example, and also serving to join at least two of said rods. Preferably the collar has a diameter substantially the same as the diameter of the passageway and/or aperture.

According to yet another aspect of the invention the top and/or bottom rails include a receiving member to receive an extension to the door with a corresponding mating member. This extension to the door can be decorative or functional and can be easily replaced upon wear or change in utility.

According to one additional aspect of the invention, there is a kit for assembling a modular door comprising:

a. at least one door panel;

b. at least two pre-manufactured stiles each having two ends and two sides, provided with mortises along one of the sides and a first passageway having a diameter and passing through said mortises;

c. at least two pre-manufactured rails each having two sides and two ends with tenons provided at each end while each tenon has a predrilled aperture to receive at least one rod, preferably a plurality of rods; and d. at least one rod, preferably a plurality of rods to lock the rails to the stiles via said predrilled aperture and said first passageway, wherein the at least one of said rods further comprises at least one stabilizer.

The at least one rod, preferably a plurality of rods, can include two short locking rods of sufficient length to lock one rail to the stile and two long locking rods of sufficient length to lock at least two rails to the stile. More preferably, the plurality of rods has at least six locking rods to lock at least three rails to the stiles, and at least two pushing rods to deliver the locking rods into the distant mortises of the stile. Still more preferably, each stile has at least one locking rod, one pushing rod pre-inserted into a first passageway proximate mortise, distant from one of the ends of the stile.

In yet another embodiment there can be an unlocking rod further positioned between the pre-inserted locking rod and pushing rod and a filler rod holding these rods in place during storage and delivery.

According to yet another aspect of the invention, the at least one of said rods of the kit, preferably said locking rods, further comprise at least one stabilizer, preferably at least one o-ring, positioned on said rod, to minimize movement of said rod in said passageway and/or aperture. Preferably, said stabilizer is substantially the same diameter as a diameter of the passageway and/or aperture. In a preferred embodiment, the o-ring may be made of any material known in the art for making o-rings including, but not limited to, polymeric elastomer, natural rubber, synthetic rubber and the like. The function of the o-ring is to ensure a snug fit of the locking rod in the passageway and/or aperture whilst minimizing the locking rod from moving around in the passageway of the stiles and aperture of the rails.

According to another embodiment, the at least one stabilizer is integral with at least one of said rods of the kit. The integral at least one stabilizer is, in one embodiment, made from the same material as the rod and may be in a shape conforming to a shape of the passageway and/or aperture. In another embodiment, the at least one stabilizer is moveable along a length of at least one of said rods. In another embodiment, the stabilizer may be in the form of a collar, for example, and also serving to join at least two of said rods. Preferably the collar has a diameter substantially the same as the diameter of the passageway and/or aperture.

Preferably the kit also has at least one door extension member capable of being attached to at least one of the rails.

According to yet another aspect of the invention, there is provided a method of assembling a modular door said door comprising at least one door panel having a top, a bottom and two sides; a first pre-manufactured stile having a first end, a second end and two sides; one of said sides further comprising at least one mortise, preferably a plurality of mortises; a second pre-manufactured stile having a first end, a second end and two sides; one of said sides further comprising at least one mortise, preferably a plurality of mortises, wherein each stile further comprises a first passageway for receiving at least one rod, preferably a plurality of rods, wherein said first passageway extends from the first end of the stile to the second end of the stile passing through at least one of said mortise of the stile; a first pre-manufactured rail having two sides, a first end defining a first tenon and a second end defining a second tenon, wherein each tenon has an aperture to matingly receive at least one rod, preferably a plurality of rods, a second pre-manufactured rail having two sides, a first end defining a first tenon and a second end defining a second tenon, wherein each tenon has an aperture to matingly receive at least one rod, preferably a plurality of rods, preferably each of said first passageway and said aperture are substantially of the same diameter; each of said stiles and rails for use in enclosing said at least one door panel; optionally, at least one intermediate pre-manufactured rail having two sides, a first end defining a first tenon and a second end defining a second tenon, wherein each tenon has an aperture to matingly receive at least one rod, preferably a plurality of rods, and positioned between said first rail and said second rail and enclosing said at least one door panel, each of said rails being attachable to the first and second stiles by said mortise of said stile engaging with said tenon of said rail, further affixed in place by at least one rod, preferably a plurality of rods, and wherein at least one rod, preferably two of the plurality of rods lock a single rail, preferably a plurality of rails inside the corresponding stile, wherein upon the insertion of said tenon into said mortise of each stile, the first passageway and apertures are positioned offset one to another, comprising the following steps of:

1. Inserting the first tenon of the first rail into a first mortise of the first stile;
2. Locking said first tenon in said first mortise with a first rod;
3. Positioning the at least one door panel adjoining said first rail and first stile;
4. Inserting the first tenon of the second rail in to a second mortise of the first stile while locking the first door panel in place;
5. Positioning a second stile on the side of the rails distant from the first stile, wherein the second tenons of each of the first rail, the second rail and the optionally at least one intermediate rail are inserted into the corresponding mortises of the second stile and the first and second door panels are also locked in place; and
6. Locking the second tenons of the rails in the second stile using a second rod;

wherein the first and second rods further comprise at least one stabilizer.

In a preferred embodiment, the method of assembling the door further comprises the steps of:

1. positioning a second door panel adjoining said second rail and the first stile;
2. inserting the first tenon of the at least one intermediate rail into a third mortise of the first stile while locking the second door panel in place; and
3. locking the First tenon of the second rail and the first tenon of the optionally at least one intermediate rail in corresponding mortises oldie first stile using a third rod;

In another preferred embodiment, the method of assembling the door further comprises the steps of:

1. Inserting a bushing in an opening of the first passageway; and
2. Inserting a screw into said bushing to secure the rods to the stiles.

According to yet another aspect of the invention, the rods used in the assembling of the door comprise at least one stabilizer, preferably at least one o-ring, positioned on the rods, to minimize movement of the rods in said passageway and/or aperture. Preferably, said stabilizer is substantially the same diameter as a diameter of the passageway and/or aperture. In a preferred embodiment, the o-ring may be made of any material known in the art for making o-rings including, but not limited to, polymeric elastomer, natural rubber, synthetic rubber and the like. The function of the o-ring is to ensure a snug fit of the rods in the passageway and/or aperture whilst minimizing the rods from moving around in the passageway of the stiles and aperture of the rails.

According to another embodiment, the at least one stabilizer is integral with at least one of said rods used in the assembly of the door. The integral at least one stabilizer is, in one embodiment, made from the same material as the rod and may be in a shape conforming to a shape of the passageway and/or aperture. In another embodiment, the at least one stabilizer is moveable along a length of at least one of said rods. In another embodiment, the stabilizer may be in the form of a collar, for example, and also serving to join at least two of said rods. Preferably the collar has a diameter substantially the same as the diameter of the passageway and/or aperture.

The assembled door does not require a use of glue or additional bonding agents during the assembly process.

The rods locking the rails inside each stile comprise at least one rod, and preferably more than two rods. The rods are selected from locking rods, pushing rods, filler rods, unlocking rods and combination thereof. Preferably, a set of bushings further locks the rods inside the stiles.

Additionally, the use of Plexiglas™ gives an even broader choice of uniqueness by shining light directly on to the Plexiglas™ and using it as a light conductor through the door body to shine out the other end without the use of wires.

Another aspect of the invention is the ability to take the door apart. Disassembly of the door brings a unique factor into effect. If a door is to be disassembled due to the size being increased, design change, and/or a damaged component in the door that needs replacing, these tasks may be done easily.

The end user can accomplish the above-named tasks by removing the screw penetrating the rail and bushing and, using the same screw, drive into the center of the bushing through the rod leaving half the screw outside of the bushing. This will lock the bushing to the rod. Using this as a clamping point, the rods that hold the tenons can be unlocked by simply removing the bushing/rod at either ends of the door. Once completed, a rod of smaller diameter may be inserted. The length is determined by the following formula:

width of the tenon+plus length of bushing/rod that was removed+one inch

The rod of smaller diameter is then inserted into the door with force needed until the tip is flush with the door. Remove the rod and repeat this procedure for all the locks. The rails are unlocked from the stiles; the door can now be disassembled.

DETAILED DESCRIPTION OF THE PREFERRED EMBODIMENTS

Figure 1:
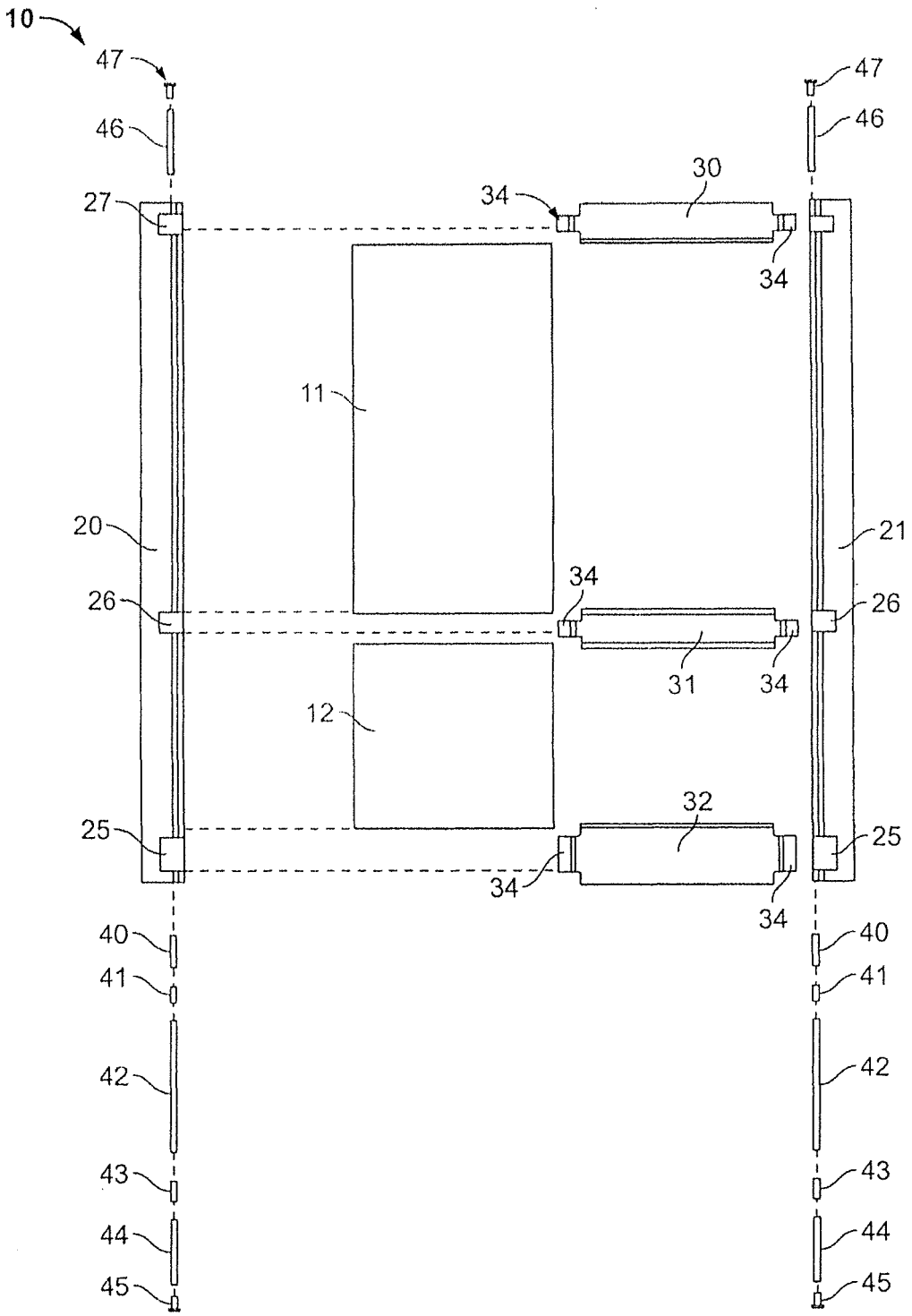
FIG. 1 is an exploded view of the modular door.

FIG. 1 illustrates an exploded view of the modular door 10. This modular door comprises a first stile 20, a second stile 21 and a top rail 30 and a bottom rail 32. The door also comprises at least one intermediate rail 31. Depending on the design requirements, the door may include additional horizontal rails between the top and bottom rails 30 and 32. Locked between the stiles and the rails, there are panels 11 and 12. The panels can be manufactured any way and from any material known to a person skilled in the art of door manufacturing, and the number of panels may vary according to the number of rails.

Figure 2:
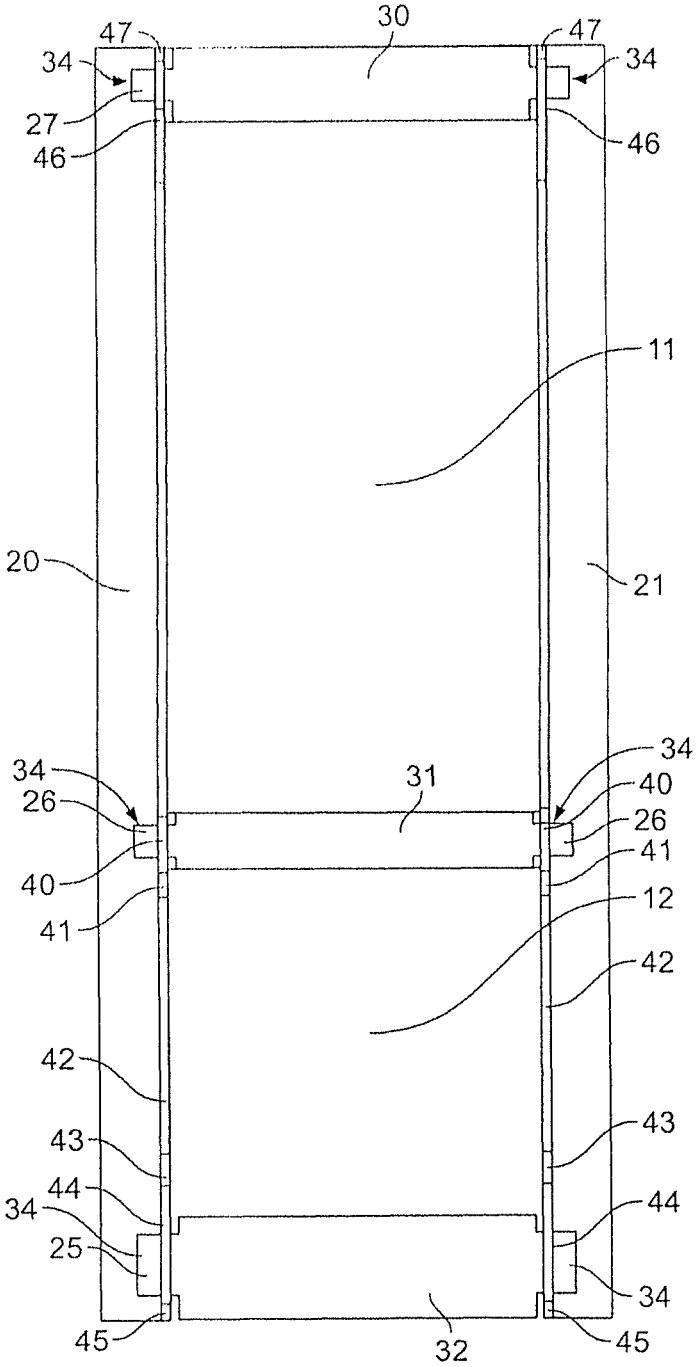
FIG. 2 is a see-through view of an assembled modular door.

Each stile comprises a plurality of mortises corresponding to a set of tenons positioned on the rails, best illustrated in FIG. 2, and there are a plurality of rods (40-44 and 46), which retain the tenons inside the mortises of each stile.

FIG. 2 illustrates rail 31 with tenon 34 positioned proximate to its corresponding mortise 26 in stile 21, and rail 32 with tenon 34 positioned proximate to its corresponding mortise 25 in stile 21 prior to the assembly process.

FIG. 2 illustrates the assembled door with tenon 34 of rail 31 completely inserted into mortise 26 of stile 20 and locked in this position by the means of rod 40. Tenon 34 of rail 32 is fully inserted into mortise 25 of stile 20 and locked in this position by the means of rod 44. Finally, tenon 34 of rail 30 is fully inserted into mortise 27 of stile 20 and locked in its position by rod 46. Rails 30, 31 and 32 are fixed to stile 21 on the opposite side of the door, in the same manner as they are fixed to stile 20.

As illustrated in FIG. 2, panel 11 is locked between rails 30 and 31 and by stiles 20 and 21, while panel 12 is locked between stiles 20 and 21 and rails 31 and 32.

Figure 3:
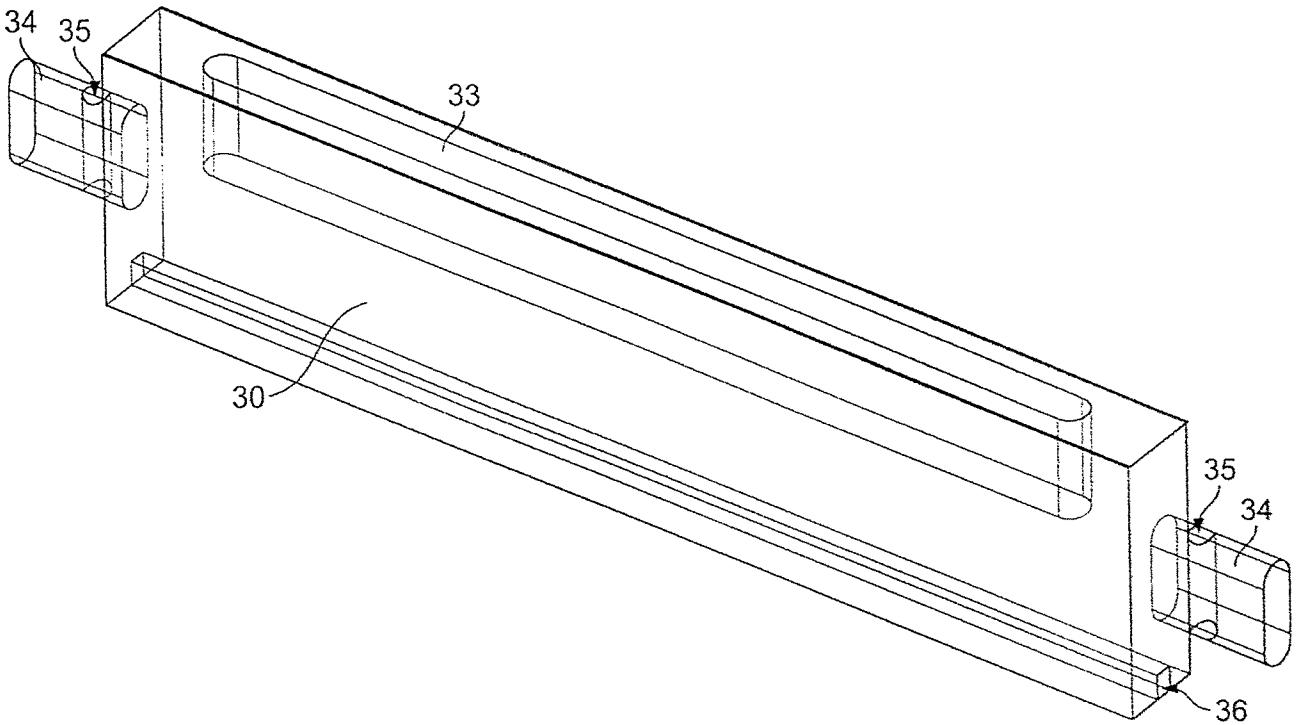
FIG. 3 is an elevated see-through view of a rail of the modular door.

Rail Manufacturing Process: See FIG. 3

1. Rail 30 is squared.
2. Groove 36 is cut vertically on one side of rail 32 down the center of the rail so panel 11 can be inserted into this groove during the door assembly.
3. A pair of tenons 34 is created on each end of rail 32.
4. Apertures 35 are drilled in each tenon. These holes receive the rods locking the mortises of the stiles.
5. In one of the embodiments, first rail 30 and/or second rail 32 may have an extra mortise 33 on a side opposite groove 36 in order to receive an extension 37. In yet another alternative embodiment second rail 32 can also have a mortise 33 to receive a bottom extension 37. All intermediate rails 31 have two grooves 36 to receive panels on both sides.
6. In a preferred embodiment, a chamfer (not shown) is applied to the tenon for better seating on assembly of the door.

In one embodiment, second rail 32 and first rail 30 are identical and can be used interchangeably to reduce the number of manufactured pieces of the door. In yet another embodiment (not shown), rails 30, 31 and 32 may be identical thus groove 36 on both sides of the rails can be used to receive a panel 12 or extension 37.

Figure 7:
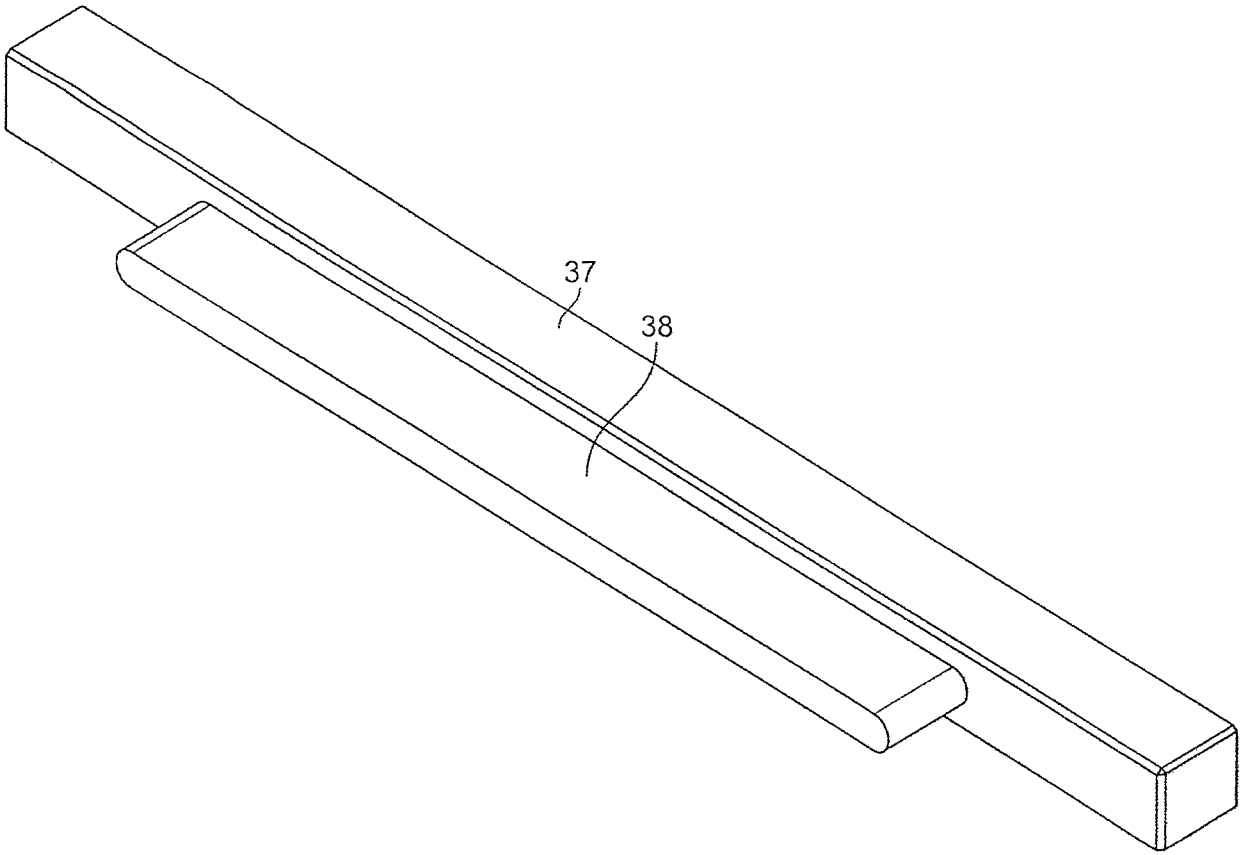
FIG. 7 is an elevated view of the extension insert into the rails.
Figure 8:
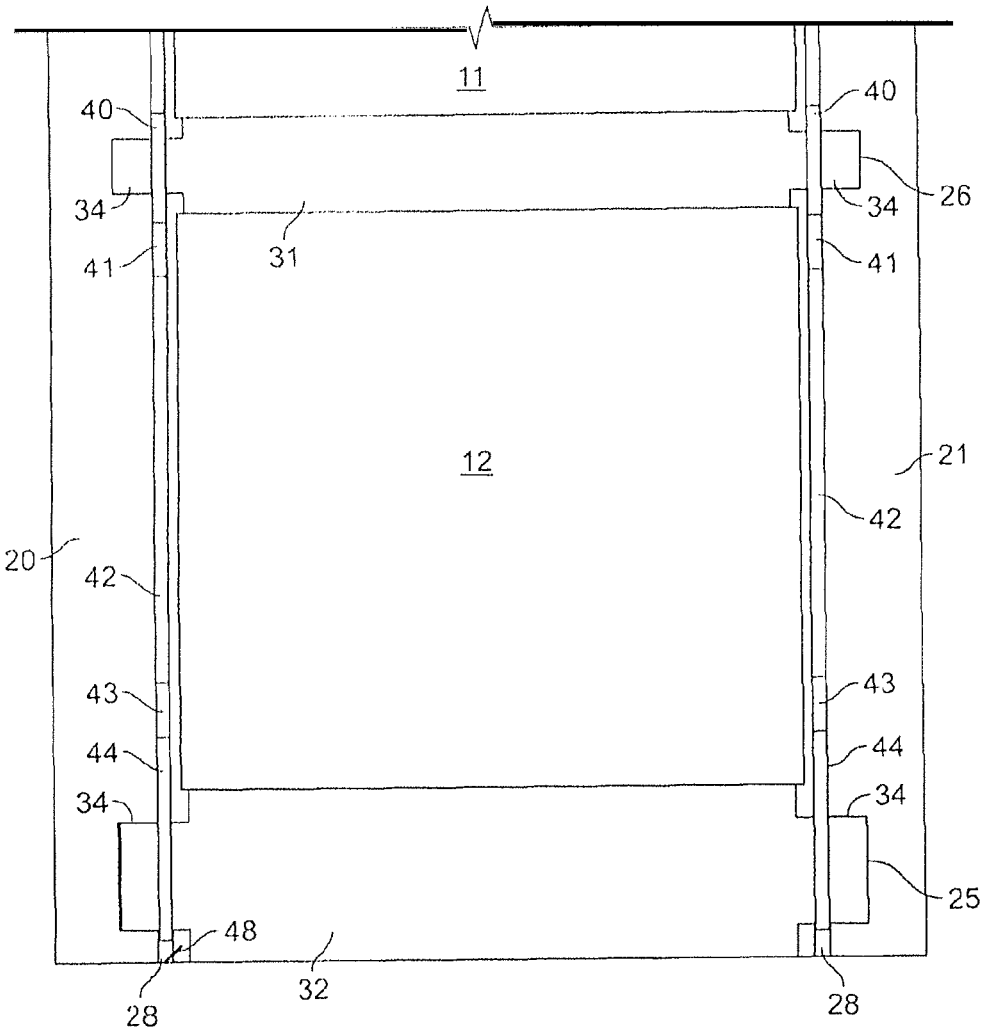
FIG. 8 is a see through partial view of the bottom part of the assembled door.

Referring to FIG. 7, extension 37 can be added to first rail 30, second rail 32 or both by the means of insertion a mating member 38 into receiving member 33 of the rails. Mating member 38 can be of any type known in the art such a ridge, tenon, and a plurality of pins, etc.

The extensions can vary in height, preferably from ¾" to 10" depending on the manufacturing materials and design. Extension 37 can be constructed from various materials such as metals, wood, plastics and composite materials. Each extension 37 can be rubberized, painted or coated to protect the insert from elements and wear.

Figure 4:
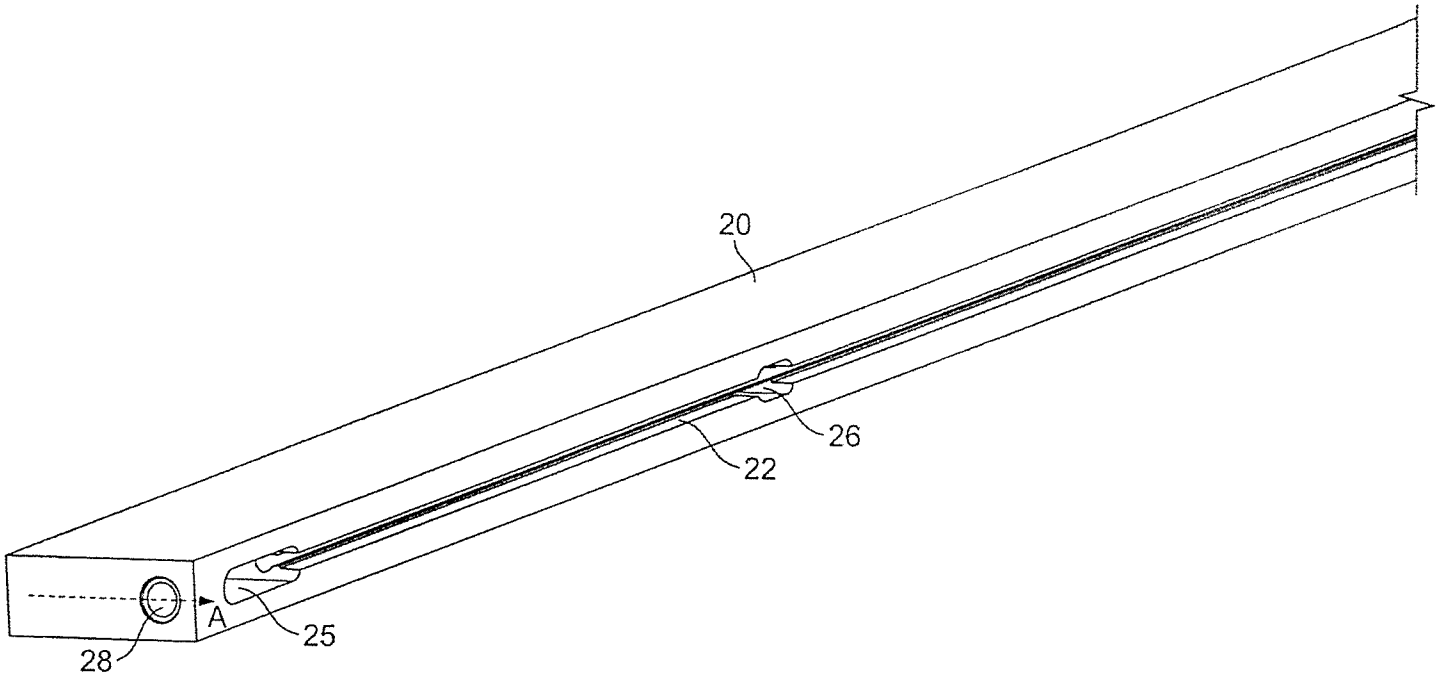
FIG. 4 is an elevated view of a stile.
Figure 5:
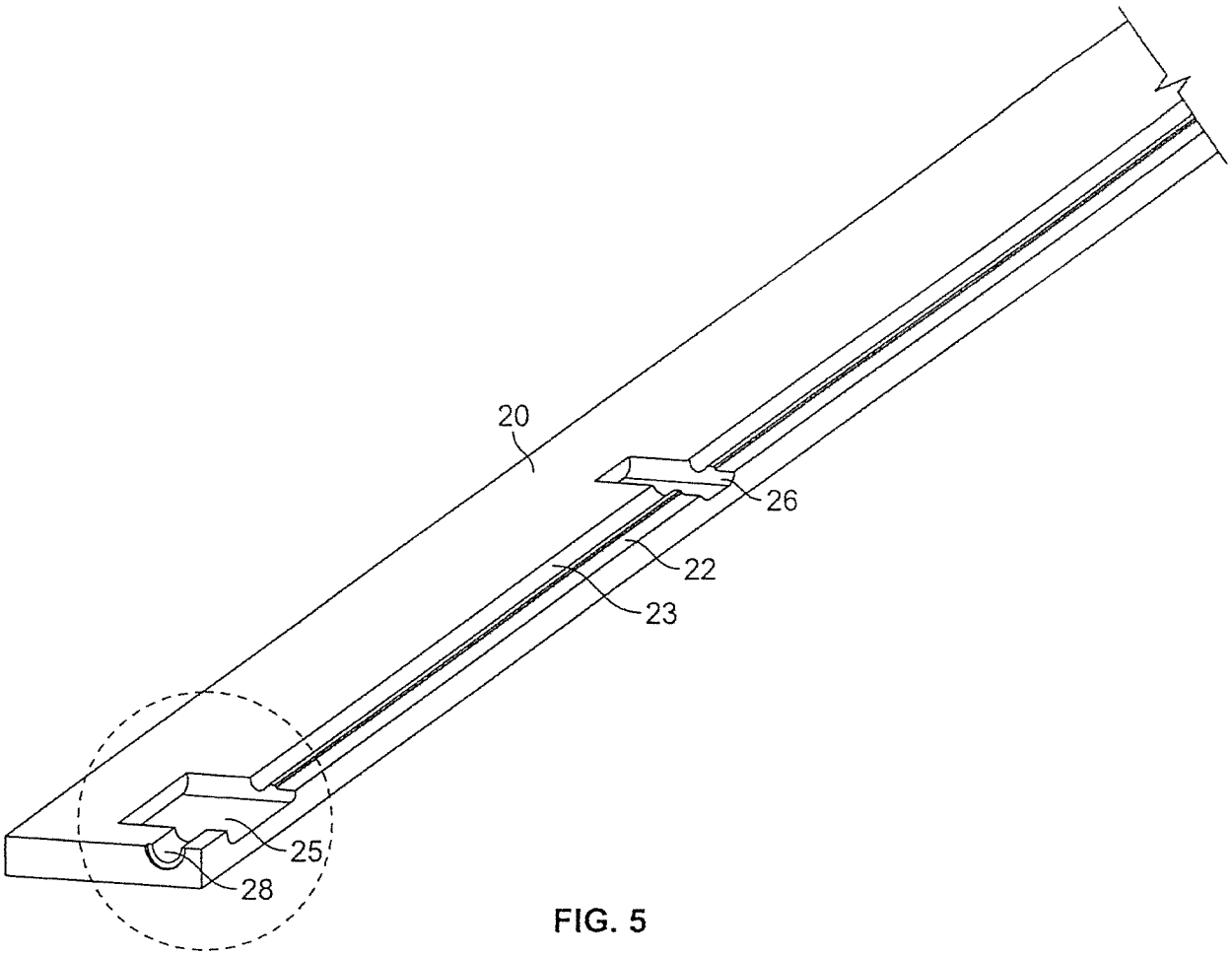
FIG. 5 is a cut view of FIG. 4 through line A-A.
Figure 6:
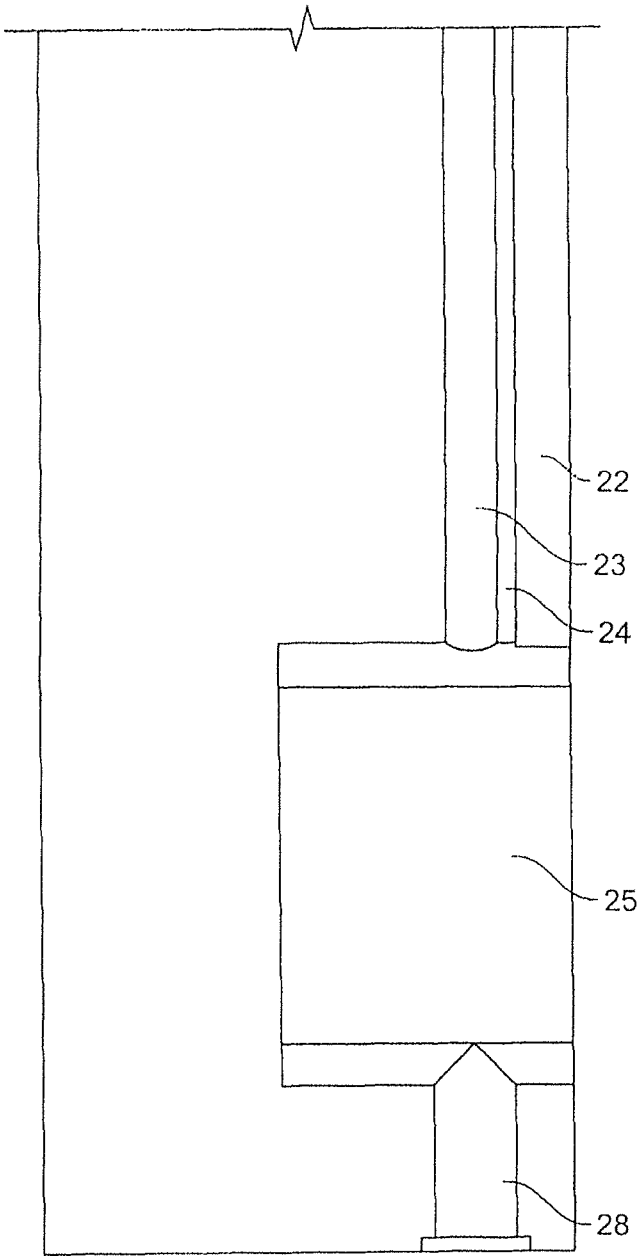
FIG. 6 is an enlarged top view of area B of FIG. 5.

Stile Manufacturing Process (FIGS. 4-6):

The manufacturing process of stile 20 is similar to the manufacturing process of stile 21. The only difference is the preparation and positioning of the hardware on these stiles.

1. Stile 20 is squared and beveled.
2. A plurality of mortises 25, 26, 27 are cut into stile 20 according to design.
3. Channel 22 is cut down the center of stile 20 (opposite the bevel) so panels 11 and 12 can be inserted during an assembly process.
4. First passageway 23 is provided down the center of the stile just short of the top and bottom keeping the integrity intact. This passageway receives rods locking the tenons of the rails in the mortises of the stile. Passageway 23 can be lined (not shown) with a plastic or metal sleeve in lieu of wood. Passageway 23 is placed a few millimeters behind groove 22 that holds panels 11 and 12 in place in order not to lose the integrity of groove 22.

Figure 16:
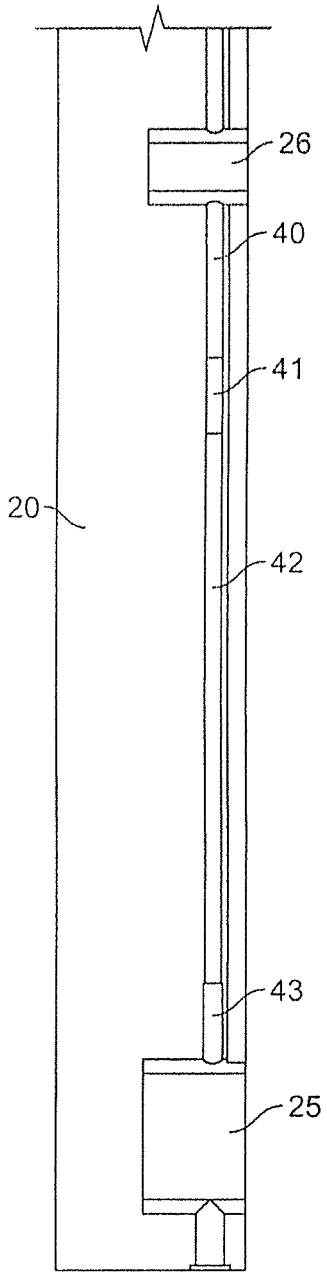
FIG. 16 is an illustration of stile with pre-inserted rods.

5. Bushing holes 28 are drilled at the top and bottom of stile 20 continuing where the passageways left off to accept a wood, plastic, Plexiglas™ or metal bushing/rod.
6. In a preferred embodiment as illustrated in FIG. 16, at least some of the plurality of rods 40, 41, 42 and 43 are strategically pre-inserted into first passageway 23 to save on assembly time of the finished door for the end user.
7. With reference to FIG. 16, rod 40 (referred to as a "locking rod") can be placed at the very edge of mortise 26. It can enter from the bottom or top of the stile from which a hole was created to accept a bushing (depending on the design of the mortises). Once rod 40 has entered the passageway, a small amount of force can be applied in order to set it into place.
8. Rod 41 (referred to as an "unlocking rod") can enter from the following mortise and be placed behind the first rod. Little to no force is needed to position this rod, as this rod has a smaller diameter than rod 40. Rod 42 can also use the same path as rod 40 and can be placed directly against rod 41. Little to no force is needed to position rod 42, as it too has a smaller diameter than the rod 40. Rod 43 can be placed against rod 42 and enter from the mortise like rod 41 (short in length). Rod 43 is provided in order to keep rods 40, 41 and 42 in place during the transportation. A small amount of force is need to position rod 43. This may all be repeated depending on the design chosen.

The plurality of rods have varied lengths, at least two of which are of smaller diameter and can be made of wood, plastic, Plexiglas™, metal or other material known in the art. The length of rod 40 preferably corresponds to the width of tenon 34 plus two inches.

Rod 41 has a length preferably corresponding to the width of tenon 34 and has a smaller diameter than rod 40.

Rod 42 is preferably a few inches short of the following mortise, as well as being of a smaller diameter.

Rod 43 fills the remaining gap to the edge of the mortise and preferably has the same diameter as the passageway.

The lengths of the rods are determined by the design. If using multiple rails 31 and if locking from one side top or bottom, approximately 2 inches or the width of the tenon should be added to rod 41 for every rail added.

Rods 40, 41, 42, 43, 44, 46 are provided to lock the tenons inside the mortises, and to move the neighboring rods into correct positions. The rods can vary in diameter from about ¼" to about 1". The material of the rod can vary according to the design, size and weight of the door. The material can be selected from metals (such as steel or metal alloys), wood species, Plexiglas™, plastics, etc.

According to yet another aspect of the invention, one long rod may replace all rods 40-44, and this long rod may lock both rails 31 and 32 to stile 20.

Figure 9:
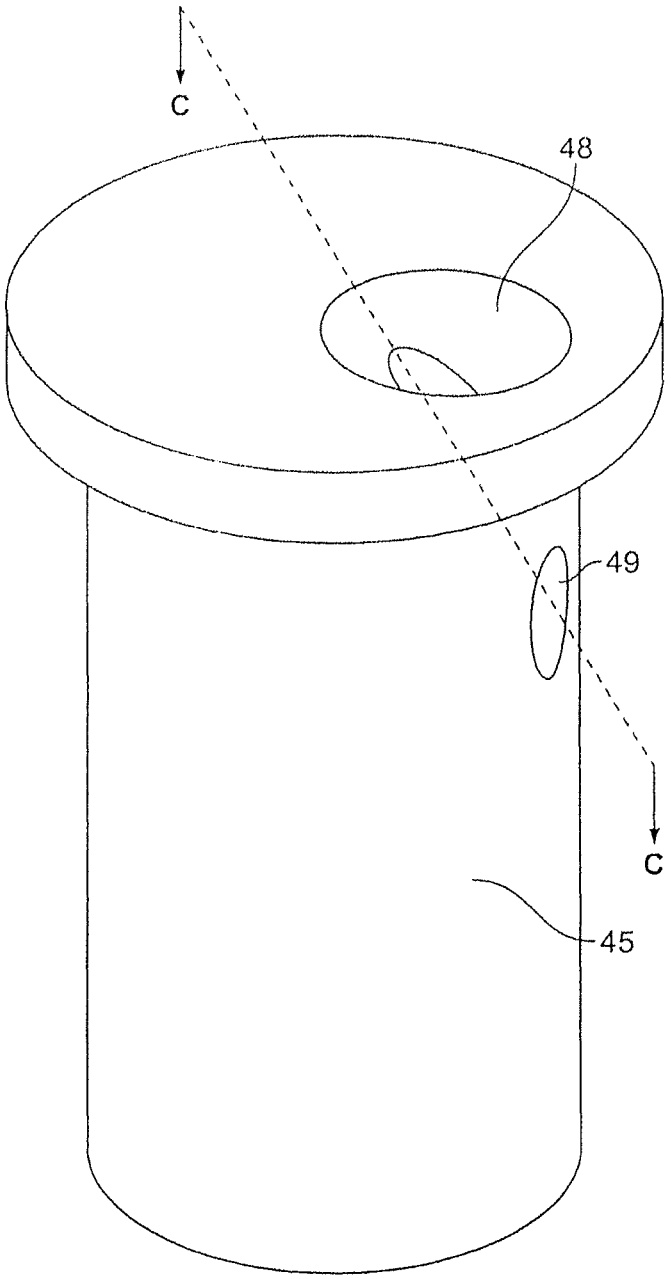
FIG. 9 is an elevated view of the bushing.

FIG. 9 provides an illustration of bushing 45. Bushing 45 (as well as corresponding bushing 47 in FIG. 1) is provided to lock the rods in their position and to prevent movement of the rods away from first passageway 23.

Figure 10:
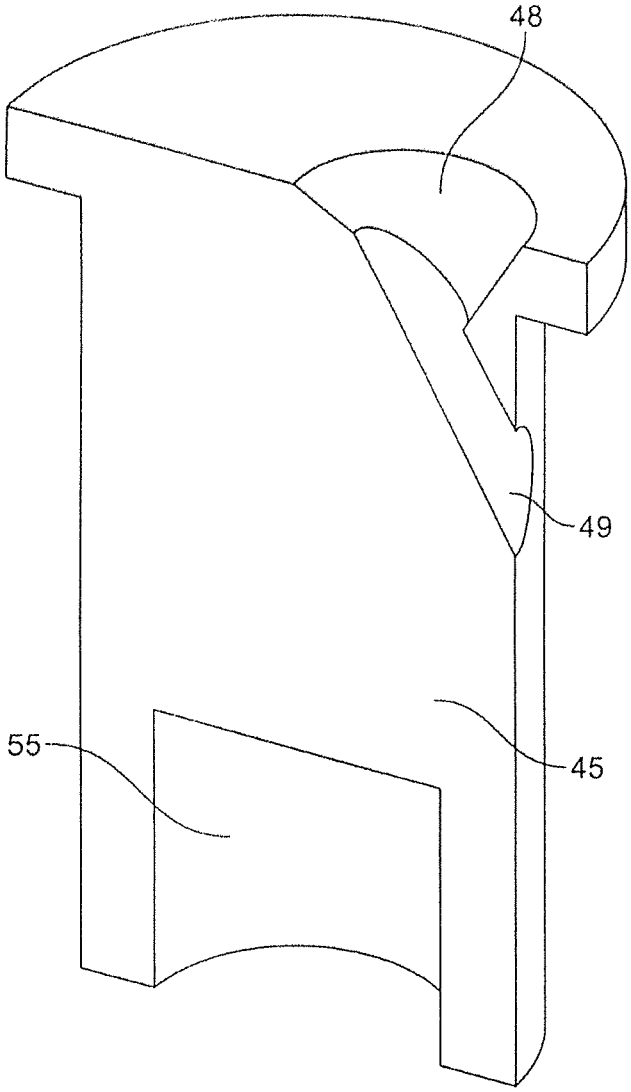
FIG. 10 is a cut view of FIG. 9 through line C-C.
Figure 11:
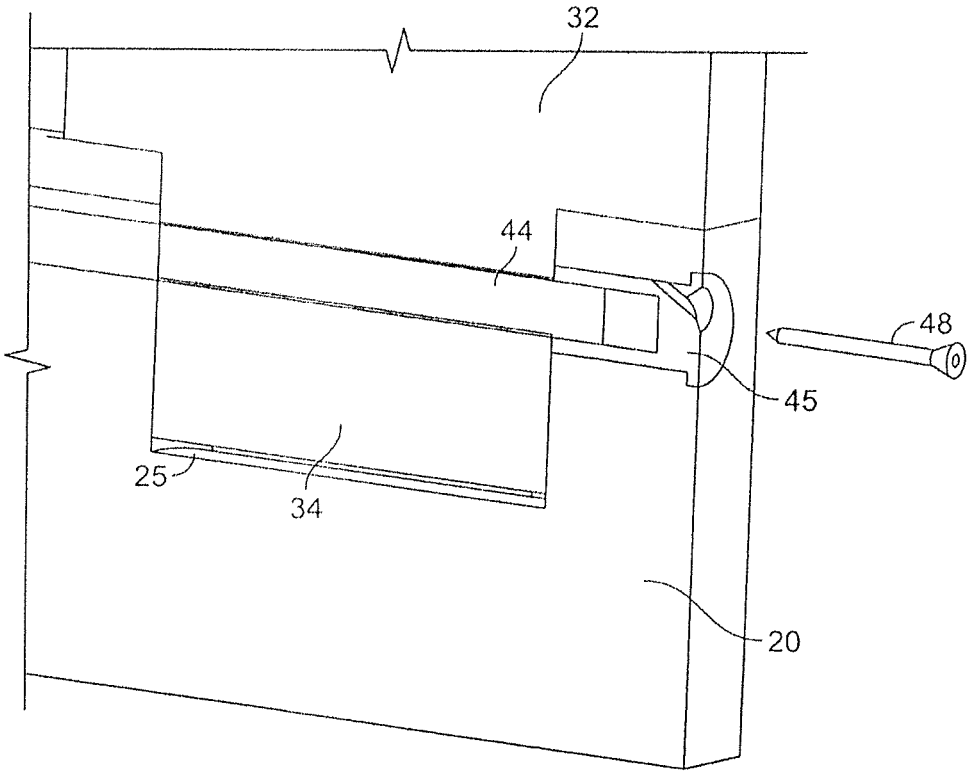
FIGS. 11-15 illustrate the process of disassembly of the modular door.
Figure 12:
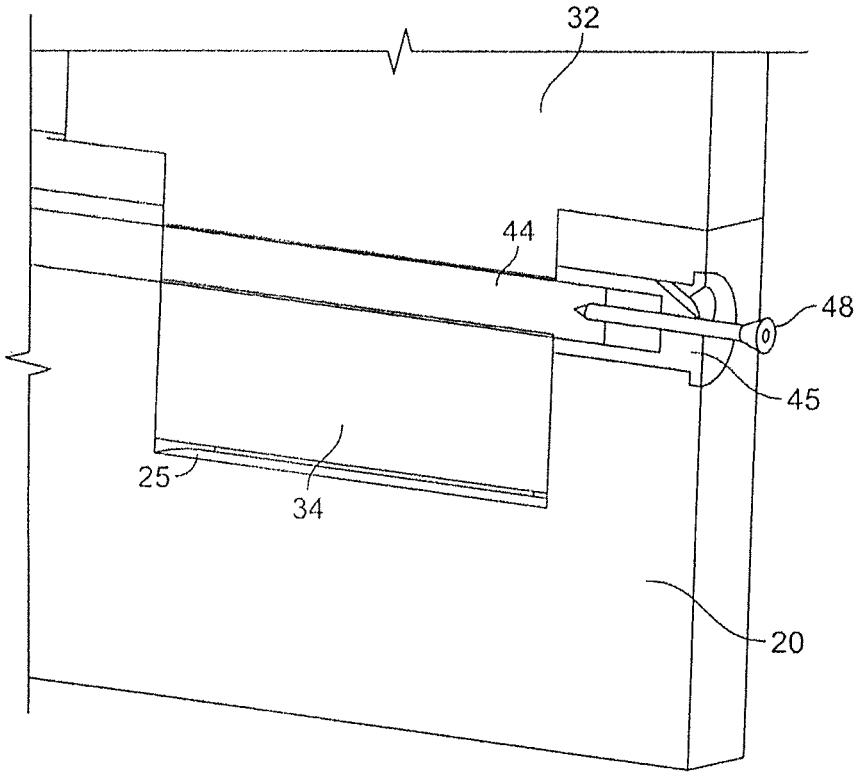
Figure 13:
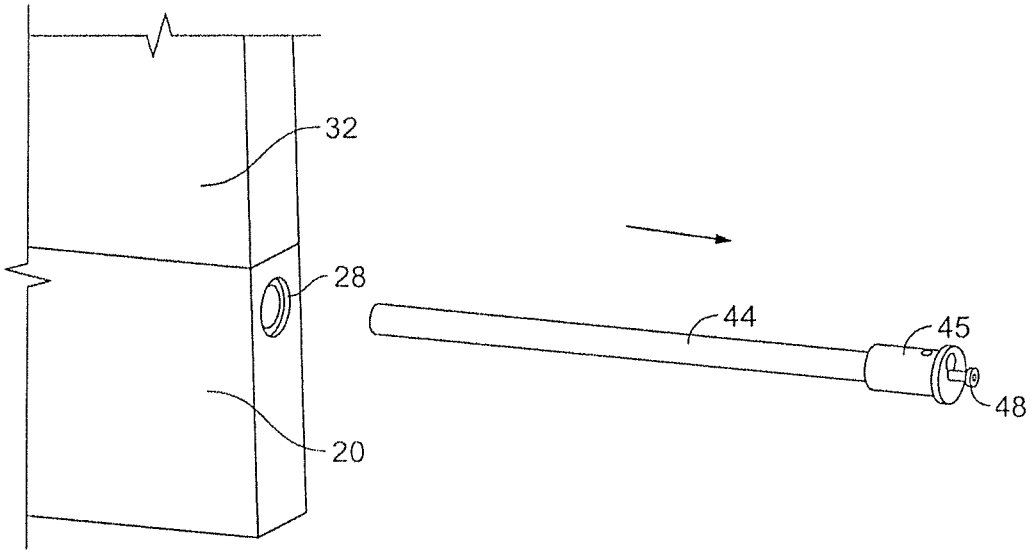
Figure 14:
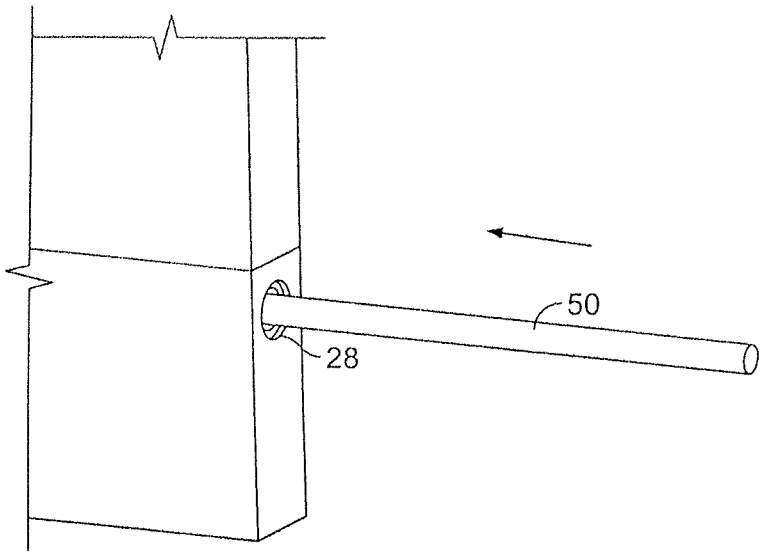
Figure 15:
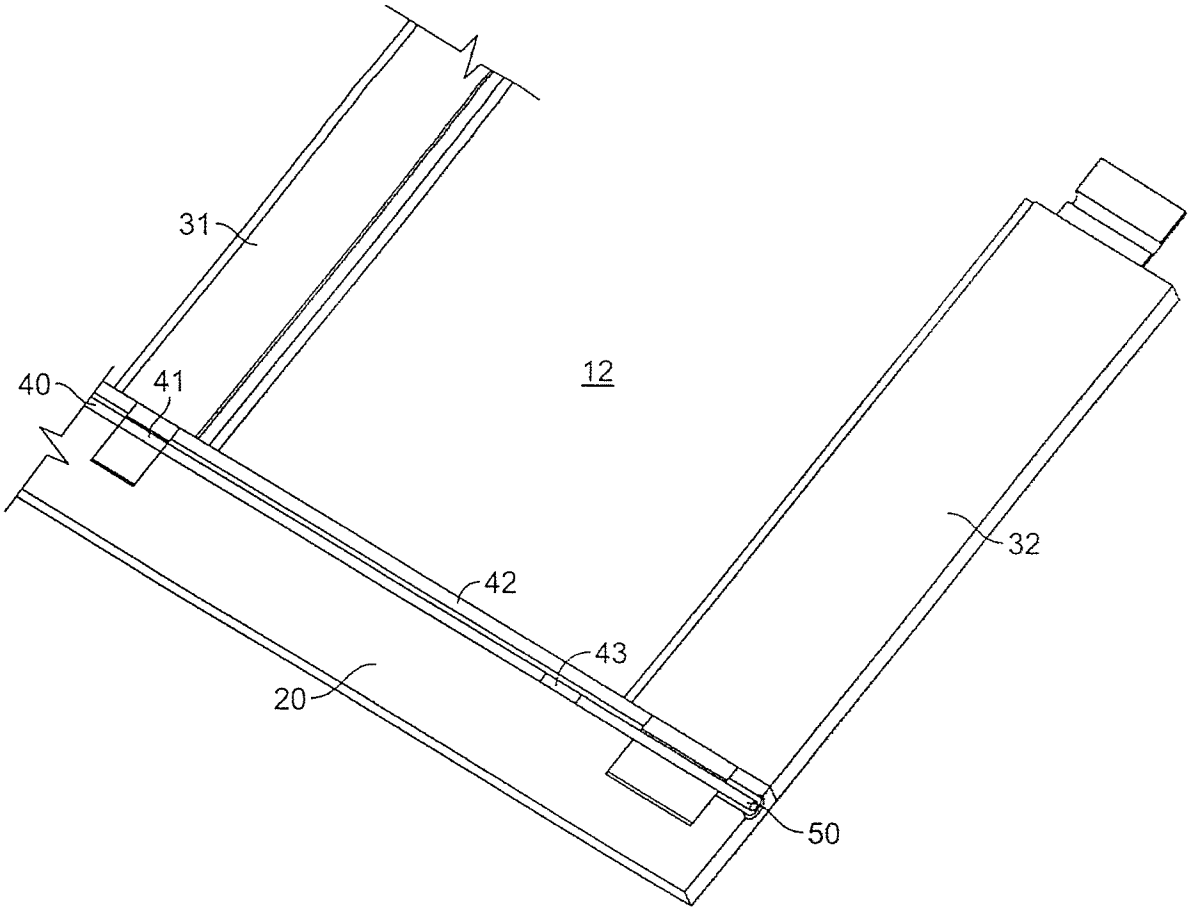

Bushing size can vary in length and diameter in lengths of about 1" to about 3" and diameters of about ½" to about 1⅝". The material of the bushing can be selected from metals such as steel or metal alloys, wood species, clear Or colored Plexiglas™, plastics, etc. In one preferred embodiment, bushing 45 is coupled with bottom rail rod 44. This rod can be locked in seat 55 (see FIG. 10) by any means known in the art. In addition, bushing 45 has a tapered screw hole 48 allowing the bushing to be locked both to stile 20 and rail 30.

In the same manner bushing 47 may be coupled with the top rod 46.

Figure 17A:
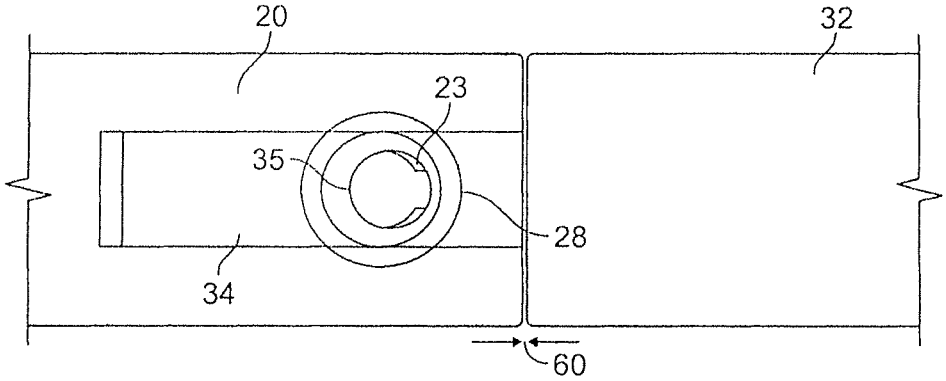
FIGS. 17A and 17B demonstrate the interaction of the rail and stile in locked and unlocked state.

FIGS. 17A and 17 B

Figure 17B:
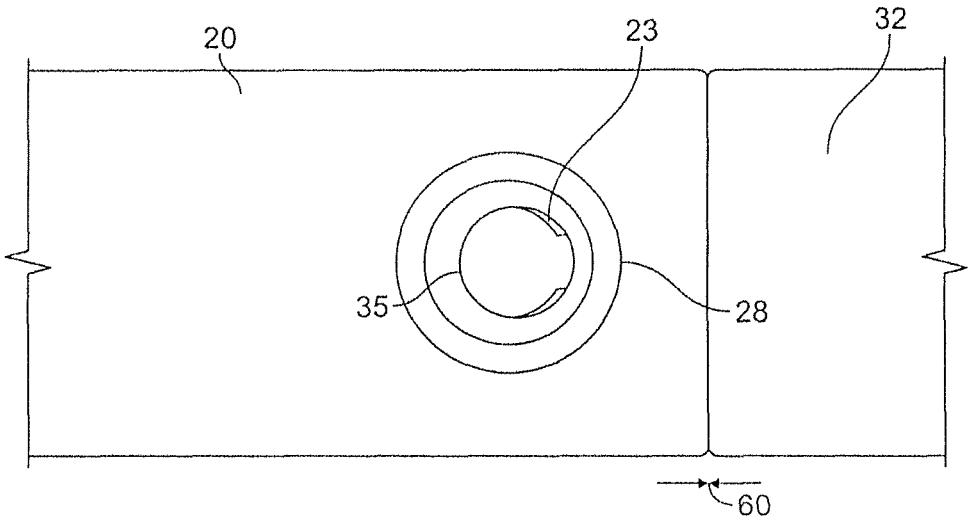

In a preferred embodiment, aperture 35 in tenon 34 is created in an offset from the center line of first passageway 23 of stile 20, thus creating a pre-tensioned joint. This is done in order to create a pulling force on tenon 34 into their corresponding mortises when the rods are inserted. This force therefore, closes the gap G between the two components (the gap 60 in FIG. 17B is smaller than the gap 60 in FIG. 17A). This force causes a tight attachment between the components and therefore eliminates the need of using a clamp press for gluing the door. Further, it virtually eliminates the use of glue in the door assembly process, making the process simpler, faster and economically effective.

Figure 18:
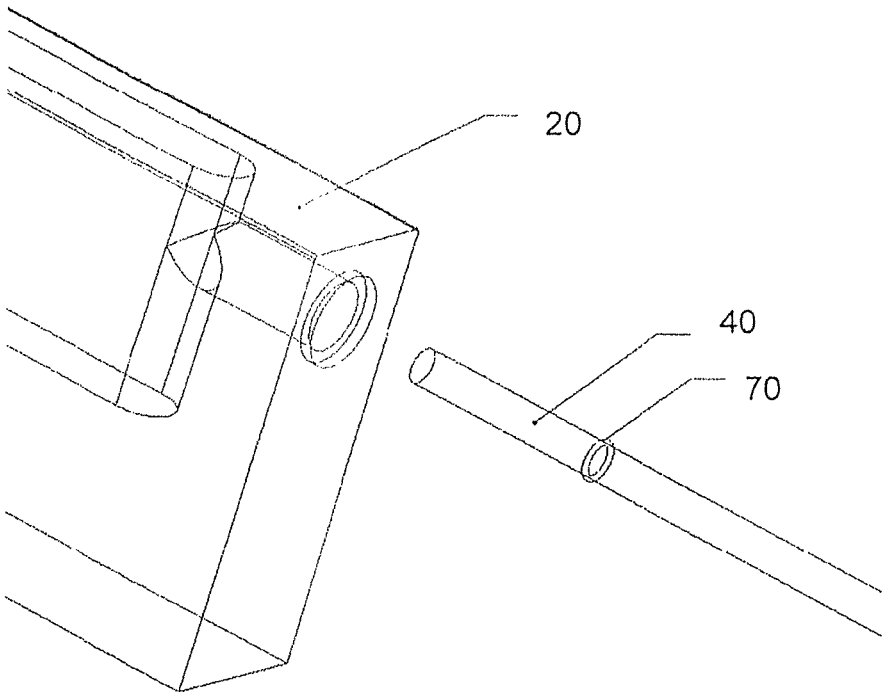
FIG. 18 shows another embodiment of the locking rod.
Figure 19:
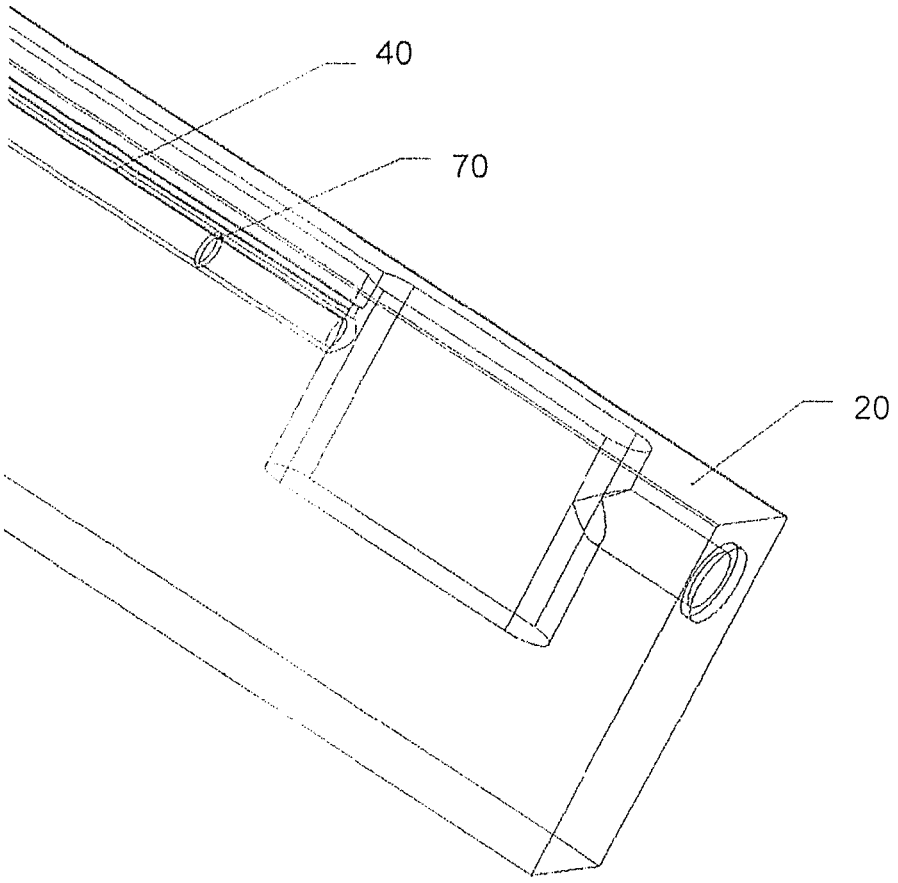
FIG. 19 shows another embodiment of the locking rod.

FIGS. 18 and 19

With reference to FIGS. 18 and 19, rod 40 further comprises at least one o-ring 70 positioned on the rod and having substantially the same diameter as the diameter of the first passageway 23 and the aperture 35. The o-ring is made of any material known in the art for making o-rings including, but not limited to, polymeric elastomer, natural rubber, synthetic rubber and the like. The function of the o-ring is to ensure a snug fit of the rod in the passageway and aperture and preventing the rod from moving around in the stiles and rails. In this embodiment, the resilient nature of the o-ring material allows the rod to fit snuggly within the aperture and the first passageway to prevent lateral and longitudinal movement within the aperture and the first passageway.

Process of Assembly: See FIG. 1.

An example of the modular door assembly process is provided below.

In one of the embodiments, the mortises, tenons, channels and rods can be sprayed or covered with substances known in the art, to allow smooth insertions of tenons and rods.

1. Stile 20 is positioned on a flat surface.
2. First rail 30 is attached to the top of stile 20 with tenon 34 inserted into mortise 27.
3. Rod 46 comprising an o-ring is inserted with appropriate force into its final resting position generating a force from the offset created in the manufacturing process to close gap 60 between stile 20 and rail 30 and locking it into position.
4. Bushing 47 locks rod 46 followed by driving a screw 48 in an angle through bushing 47 into rail 30, locking the bushing to stile 20 and rail 34 simultaneously. In a preferred embodiment, bushing 47 is coupled with rod 46 prior to insertion into first passageway 28 to make the process of assembly more convenient and reducing the chance of damaging the dowel.
5. Panel 11 (or panels if required by design) is inserted into panel channels 36 and 22.
6. Intermediate rail 31 (or multiple rails) is inserted into stile 20 by insertion of tenon 34 into mortise 26.
7. Panel 12 (or panels if required by design) is inserted into panel channels 36 and 22.
8. Second rail 32 is inserted into stile 20 by insertion of tenon 34 into mortise 25.
9. Rod 44 comprising an o-ring is inserted with the appropriate force into its position, while at the same time pushing pre-inserted rods 40, 41, 42 and 43 into their final resting position. This will generate force from the offset closing the gap between stile 20 and both middle rail 31 and bottom rail 32 simultaneously.

A screw 48 is driven into bushing 45, locking the bushing to rail 32 and stile 20.

10. Stile 21 is placed in a corresponding position and force is applied bringing the stile down to its final seating, mating tenon 34 of rail 30 with mortise 27, tenon 34 of rail 32 with mortise 26 and tenon 34 of rail 32 with mortise 25.
11. Rod 46 comprising an o-ring is inserted with the appropriate force into its final resting position generating force from the offset created in the manufacturing process to close the gap 60 between stile 21 and rail 30 and locking it into position. Rod 46 is locked with bushing 47, then a screw 48 is driven into bushing 47 to connect it to rail 30 and stile 21. (Preferably bushing 47 is coupled with rod 46 as explained above.)
12. Finally, rod 44 comprising o-ring 70 is installed with the appropriate force into its final resting position, while at the same time pushing the pre-inserted rods 40, 41, 42 and 43 into their final resting position, which will generate force from the offset to close the gap between both stile 21 and mid and bottom rails 31 and 32 (and/or multiple rails) simultaneously.

Rod 44 is locked with bushing 45 and screw 48 is driven into bushing 45 ultimately to lock rail 32 to stile 21. (Preferably bushing 45 is coupled with rod 44 as mentioned above.)

Alternatively, in a further embodiment of the invention, glue or another bonding agent can be added to all mortises and tenons to add strength to the door, if the door will not be disassembled. However, this addition of glue prior to assembly does not extend the assembly time since there is no need to wait for the glue to dry.

Disassembly Process (FIGS. 11-15)

There may come a time when a modular door may need to be disassembled to replace worn or damaged parts. If glue was not utilized during the assembly, disassembly is relatively easy.

Steps for the full disassembly of the modular door are provided below; but in most ases, a partial disassembly of the door will suffice.

1. Remove screw 48 locking the bushings to rail and stile. (See FIG. 11.)
2. Drive a screw through the center of the bushing into the rod, locking the rod and bushing together. A good portion of the screw should be left protruding so that it can be used as an anchoring point for the bushing and rod to be removed (See FIG. 12.)
3. Use a claw end of a hammer or other tool known in the art; remove the hushing and rod attached by the screw, using a technique known to a person skilled in the art.
4. Repeat the above procedure with all bushings.
5. Using a rod 50, (preferably made of steel, with a substantially smaller diameter and having sufficient length to push the rod 41 into tenon 34 of rail 31) remove rod 40 from tenon 34 of rail 31 by placing rod 50 into the hole and drive it forward until the tip is flush with the edge of the door (see FIG. 15).
6. Rod 50 is then removed from the first passageway using tools known in the art. Rod 50 used to push the rods 40, 41, 42 and 43 may vary in length due to design.
7. The door can now be taken apart. The mortise and tenons are unlocked.

Advantages of the Modular Door Kit

1. Before assembly the stile can be machined for hardware installations such as hinges and or locks. A single stile simplifies handling, unlike manipulating the entire assembled door.
2. Shipping the components in a disassembled state makes the process of loading/unloading from dock level, truck, or condo elevator much easier to manage.
3. This novel process gives the customer on-the-spot flexibility in design, dimensions and integrity with multiple choices of materials and designs that can be used. For example, pre-manufactured parts of the door (such as the door panels) can be constructed from different materials to fit the custom design selected by the end user at the store.
4. This vast customization factor eliminates delays and reduces material and labour costs that are incurred as a matter of course when manufacturing custom doors.
5. After assembly is complete, the door can be installed immediately whether an end user chooses to assemble it with or without glue.
6. Do-it-yourself end users have the opportunity to assemble the door themselves, thus furthering labour cost savings.
7. The pockets 36 created on the top and bottom of the door rails provide the customer with an option of extending the height of a door to match high door openings, allowing an existing door to be reused rather than replaced. Depending on the chosen material, inserts 37 can make the door more resistant to the elements, increase its integrity or simply bring about a design change.
8. In a preferred embodiment, when the door is assembled without a bonding agent, the end user has the advantage of greater flexibility in design, dimensions, replacement of damaged components, or even disassembly that was not previously available.

In one of the alternative embodiments, by using a Plexiglas™ or other transparent material in bushing/dowel and rods the door can be illuminated. A light source can be placed on either the top or bottom of the door and, using the Plexiglas™ as a conductor to carry light through the door can create a unique look without the need to run any wires through the door.

Design options may include choosing transparent, semi-transparent, or light scattering features on selected parts of the door. For example, an illumination from the sill of the door can be transferred through hard transparent dowels to similarly constructed top and/or bottom rails, providing such a door with a unique illuminating feature. The transparent or otherwise light scattering inserts can be positioned in the rails, panels and even stiles.

The scope of the claims should not be limited by the preferred embodiments set forth in the examples, but should be given the broadest interpretation consistent with the description as a whole.

I claim:

1. A modular door comprising:

a. at least one door panel having a top, a bottom and two sides;

b. a first pre-manufactured stile having a first end, a second end and two sides; one of said sides further comprising at least one mortise;

c. a second pre-manufactured stile having a first end, a second end and two sides; one of said sides further comprising at least one mortise;

d. wherein each stile further comprises a first passageway having a diameter for receiving at least one rod, wherein said first passageway extends from the first end of the stile to the second end of the stile passing through at least one of said mortise of the stile;

e. a first pre-manufactured rail having two sides, a first end defining a first tenon and a second end defining a second tenon, wherein each tenon has an aperture having a diameter to matingly receive at least one rod;

f. a second pre-manufactured rail having two sides, a first end defining a first tenon and a second end defining a second tenon, wherein each tenon has an aperture to matingly receive at least one rod, each of said first passageway and said aperture are substantially of the same diameter; each of said stiles and rails for use in enclosing said at least one door panel;

g. each of said rails being attachable to the first and second stiles by said mortise of said stile engaging with said tenon of said rail, further affixed in place by at least one rod; and h. wherein the at least one rod locks a single rail inside the corresponding stile, wherein upon the insertion of said tenon into said mortise of each stile, the first passageway and apertures are positioned offset one to another, wherein upon insertion of at least one rod into said first passageway and apertures, each tenon is tightly locked into its corresponding mortise;

wherein the at least one rod further comprises at least one stabilizer.

2. The modular door of claim 1 wherein the at least one rod, further comprises pushing rods, locking rods, or locking/pushing rods, wherein the pushing rods are provided to push the locking rods into each of the first tenon and the second tenon of the intermediate rail, and the locking/pushing rods are provided to lock one rail and also to push another locking or pushing rod through the rod receiving channel of the stile.

3. The modular door of claim 1 or 2 wherein the at least one rod further comprises an unlocking rod having a length equal to the height of the tenon of the corresponding rail to be unlocked, these unlocking rods are positioned between the pushing rods and the locking rods, and can be pushed into the tenon of the rail while removing the locking rod from the tenon to release the intermediate rail from the stile.

4. The modular door of claim 1 wherein the top and/or bottom rails further comprise a receiving member to receive an extension to the door having a corresponding mating member, this extension to the door can be decorative or functional.

5. The modular door of claim 1 wherein the at least one stabilizer comprises a collar having a diameter the same as the diameter of each of the passageway and aperture for joining at least two rods.

6. The modular door of claim 1 wherein the at least one stabilizer comprises at least one o-ring having a diameter the same as the diameter of each of the passageway and aperture.

7. The modular door of claim 6 wherein the o-ring is constructed from a material selected from the group consisting of a polymeric elastomer, natural rubber and synthetic rubber, and combinations thereof.

8. The modular door of claim 1 wherein the at least one stabilizer is integral with the at least one rod.

9. The modular door of claim 1 wherein the at least one stabilizer is movable along the at least one rod.

10. A kit for assembling a modular door comprising:

a. At least one door panel having a top, a bottom and two sides;

b. a first pre-manufactured stile having a first end, a second end and two sides, one of said sides further comprising at least one mortise;

c. a second pre-manufactured stile having a first end, a second end and two sides, one of said sides further comprising at least one mortise;

d. wherein each stile further comprises a first passageway having a diameter for receiving at least one rod, wherein said first passageway extends from the first end of the stile to the second end of the stile passing through at least one of said mortise of the stile;

e. a first pre-manufactured rail having two sides, a first end defining a first tenon and a second end defining a second tenon, wherein each tenon has an aperture having a diameter to matingly receive at least one rod;

f. a second pre-manufactured rail having two sides, a first end defining a first tenon and a second end defining a second tenon, wherein each tenon has an aperture to matingly receive at least one rod, each of said first passageway and said aperture are substantially of the same diameter; each of said stiles and rails for use in enclosing said at least one door panel;

g. each of said rails being attachable to the first and second stiles by said mortise of said stile engaging with said tenon of said rail, further affixed in place by at least one rod; and h. wherein the at least one rod locks a single rail inside the corresponding stile, wherein upon the insertion of said tenon into said mortise of each stile, the first passageway and apertures are positioned offset one to another, wherein upon insertion of at least one rod into said first passageway and apertures, each tenon is tightly locked into its corresponding mortise;

wherein the at least one rod further comprises at least one stabilizer.

11. The kit of claim 10 wherein the at least one rod further comprises two short locking rods of sufficient length to lock one rail to the stile and two long locking rods of sufficient length to lock at least two rails to the stile.

12. The kit of claim 11 wherein the at least one rod comprises at least six locking rods to lock at least three rails to the stiles and at least two pushing rods to deliver the locking rods into the first passageway.

13. The kit of claim 12 wherein the each stile has at least one locking rod and at least one pushing rod pre-inserted into its rod receiving slot proximate the mortise, distant from one of the ends of the stile.

14. The kit of claim 13 wherein an unlocking rod is positioned between the pre-inserted locking rod and pushing rod and a filler rod holds these rods in place during storage and delivery.

15. The kit of claim 11 further comprising at least one door extension member capable of being attached to at least one of the rails.

16. The kit of claim 10 wherein the at least one stabilizer comprises a collar having a diameter the same as the diameter of each of the passageway and the aperture for joining at least two rods.

17. The kit of claim 10 wherein the at least one stabilizer comprises at least one O-ring having a diameter the same as the diameter of each of the passageway and the aperture.

18. The kit of claim 17 wherein the O-ring is constructed from a material selected from the group consisting of a polymeric elastomer, natural rubber and synthetic rubber, and combinations thereof.

19. The kit of claim 10 wherein the at least one stabilizer is integral with the at least one rod.

20. The kit of claim 10 wherein the at least one stabilizer is movable along the at least one rod.

21. The modular door of claim 1 further comprising at least one intermediate pre-manufactured rail having two sides, a first end defining a first tenon and a second end defining a second tenon, wherein each tenon has an aperture to matingly receive at least one rod, and positioned between said first rail and said second rail and enclosing said at least one door panel.

22. The kit of claim 10 further comprising at least one intermediate pre-manufactured rail having two sides, a first end defining a first tenon and a second end defining a second tenon, wherein each tenon has an aperture to matingly receive at least one rod, and positioned between said first rail and said second rail and enclosing said at least one door panel.

* * * * *